United States Patent [19]

Mountz

[11] Patent Number: 4,938,265

[45] Date of Patent: Jul. 3, 1990

[54] METHOD OF MAKING A TRUCK FLOOR

[75] Inventor: Elton E. Mountz, Morgantown, Pa.

[73] Assignee: Morgan Corporation, Morgantown, Pa.

[21] Appl. No.: 119,183

[22] Filed: Nov. 10, 1987

[51] Int. Cl.[5] ..... B27F 1/00

[52] U.S. Cl. ..... 144/347; 52/593; 144/3 R; 144/91; 144/350; 144/367; 156/304.5; 428/54

[58] Field of Search ..... 403/339, 340, 364; 428/53, 54, 55, 56, 60; 156/304.1, 304.5, 258, 558, 559; 144/3 R, 91, 347, 350, 354, 367

[56] References Cited

U.S. PATENT DOCUMENTS

| | | | |
|---|---|---|---|
| 2,300,728 | 11/1942 | Goss | 144/354 |
| 3,262,723 | 7/1966 | Strickler | 403/364 |
| 3,602,257 | 8/1971 | Nissen | 144/347 |
| 3,730,820 | 5/1973 | Fields et al. | 428/54 |
| 3,802,486 | 4/1974 | Forsythe | 156/304.5 |
| 3,927,705 | 12/1975 | Cromeens et al. | 156/304.5 |
| 4,128,119 | 12/1978 | Maier | 144/347 |
| 4,294,647 | 10/1981 | Strickler | 156/559 |

*Primary Examiner*—W. Donald Bray

*Attorney, Agent, or Firm*—Elliot M. Olstein; Raymond J. Lillie

[57] ABSTRACT

A method of preparing truck floor boards of a desired standard length from floor boards having differing, initial standard lengths. For the case wherein the desired standard length is less than initial standard length, one may begin with severing, by saw-cutting, from a board having at least one initial standard length, as many desired length-boards as are available; this leaves a remainder board. One may also begin with such a remainder board, as an end product of a previous execution of the method, or of a cycle of the method. A finger joint profile is cut in the trailing end surface of the remainder board, and a mating finger joint profile is cut into the leading end surface of an initial-standard-length board. By gluing, the finger jointing is completed, and from the resultant composite board, severed out by saw-cut are as many desired length boards as are available. This may leave a new remainder board of sufficient length to warrant its inclusion in a new cycle of the method. Analogous steps are taken for the case of desired standard length greater than initial standard length.

Another method comprises cutting a first board of an initial first standard length into a second board of a second desired standard length and a remainder board. The remainder board and another board of said first standard length are finger jointed and glued together to form a composite board. The composite board is then severed into another board of the second desired standard length and another remainder board. Boards of a second desired length can thus be formed in a continuous process. The preferred finger joint profile is a structure formed by the peaks and valleys of the "gear rack teeth" extending in the width direction of the board.

34 Claims, 4 Drawing Sheets

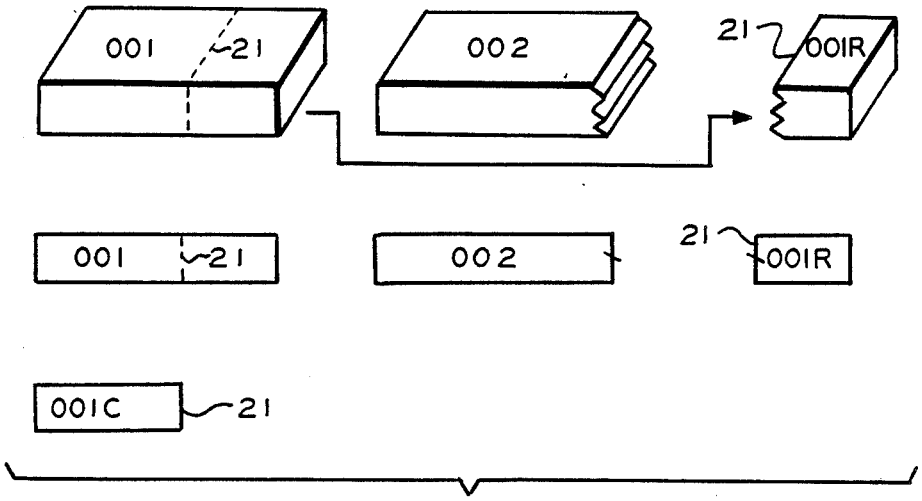
FIG. 1
FIG. 2A
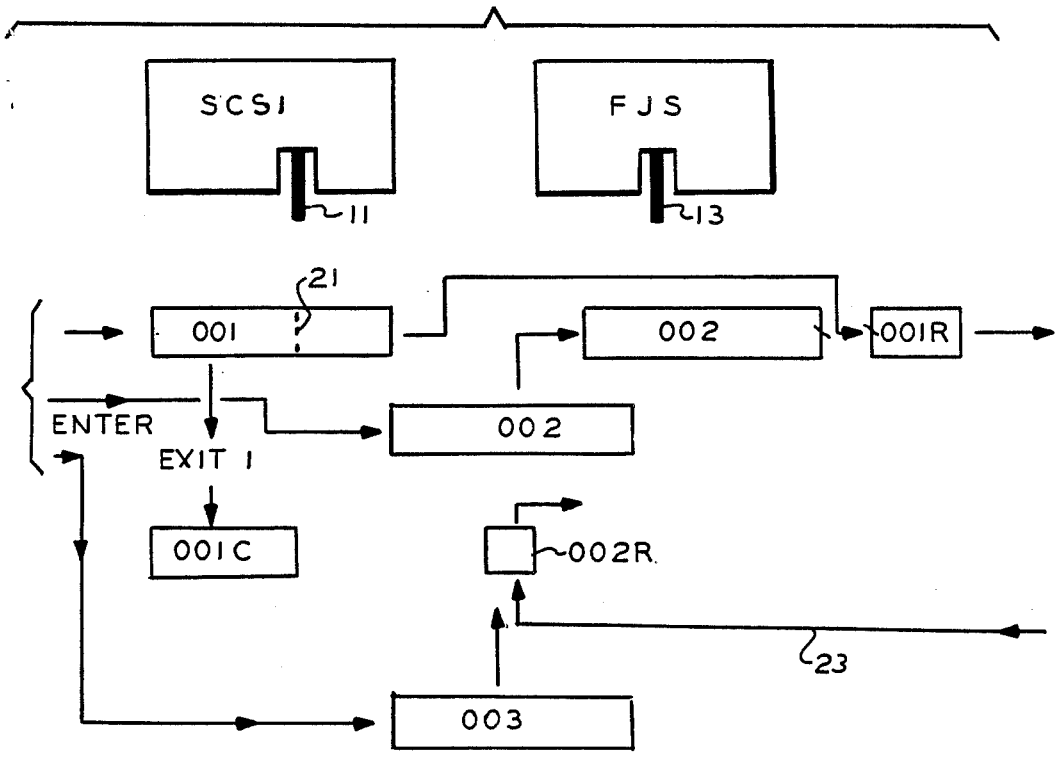

METHOD OF MAKING A TRUCK FLOOR

FIELD OF THE INVENTION

This invention relates to truck floor technology, that is flooring for trucks, vans and similar types of cargo-carrying vehicles. Such technology involves woodworking, and in particular the kind of woodworking commonly known as finger joint technology or "finger jointing". As will be seen from the following description, the present invention is directed to methodology which utilizes as starting stock material, wooden boards suitable for truck flooring, these boards being of at least one first standard length. By the methodology of the invention, and utilizing finger joint techniques, these boards are converted to truck floor boards otherwise similar to the starting stock material boards, but of a second and differing standard length. More particularly, in the herein described embodiments of the invention the final standard length may be lesser or greater than the original length, so that the final boards will fit the flooring of relatively shorter or longer size trucks.

BACKGROUND OF THE INVENTION

The motivation which gave the main impetus to the present invention is primarily economic in nature, namely minimize the scrapping of remnants resulting from the saw-cutting of truck floor boards to shorter length so as to fit trucks of shorter length. These remnants ought to be fully utilized in the forming of truck flooring, and as will be seen indeed they are as per the present invention.

Flooring which is to be suitable for utilization in trucks requires that the floor boards be of substantially greater strength than is customary for other flooring applications. The reason for this is quite evident, namely the cargo carried by trucks is a substantial load on the flooring. Truck floor boards are constructed usually in tiers of laminations. The floor board manufacturers usually situate their factories at, or near the timber lands where the trees or vegetation—suitable for truck flooring—is grown. The boards are provided in standard widths and thicknesses at the will of the floor board manufacturer; as to the lengths of the boards, these are also largely standardized by the floor board manufacturer, although the purchaser will usually be accommodated to meet his own separate needs. Because the standard lengths are quite great—twenty feet and greater, even about fifty feet are common—the manufacturer of the laminated floor boards finds it necessary to do some jointing of his own; hook jointing is commonly employed, and most of the longer boards will exhibit at least one hook joint. Such hook jointing is made during the course of the formation of the laminations which constitute the standard floor board, and should be differentiated from the jointing of completed such boards.

Floor boards which are to be assembled in the United States, or more generally in North America, are available from two principal geographic sources: North America (United States, Canada), and Malaysia. There may be other geographic sources, but economic considerations rule them out. The boards stemming from North American sources are available in soft woods, such as pine, and in the somewhat harder oak. Malaysian boards stem from hardwoods indigenous to that country; generally speaking, the Malaysian boards can be manufactured with strength characteristics comparable to those of North American boards, and in some applications, even stronger. However, there is an even more compelling reason for preference for the Malaysian boards, namely costs.

The cost of Malaysian floor boards is about 50% of the cost of comparable floor boards which stem from North American sources, with the cost of transportation and importation taken into account. However such a cost comparison must be qualified or circumscribed by a relevant limiting restriction: as of the early and middle 1980s, the importation of Malaysian floor boards into North America is, practically speaking, economical for just a few standard lengths, all under 40 feet. Although Malaysian as well as North American board manufacturers are willing to provide their purchasers with boards constructed or cut to almost any desired length, problems which are inherent in the trans-Pacific shipment, further restrict the choice of standard board lengths. Among these problems are: limitations dictated by size or shape of shipping vessels and shipping containers; the greater likelihood of the longer length boards to incur damage during shipment, especially during the loading and unloading stages; the long lead-time (as long as six months), from the date of purchase by the North American purchaser to date of receipt of the imported Malaysian boards and their availability for inventory and production needs. Routinely, production material needs were far ahead of inventory. As a result longer boards were shortened to meet the production needs. This action resulted in considerable wastage by generations of unused board remnants. Standard lengths of 20 feet and 40 feet are among the remaining practical choices for imported Malaysian boards. The description hereinafter will be given by way of example, in terms of 20 foot standard length boards, although similar considerations apply to 40 foot long boards, or boards of still another initial standard length.

Wastage of this kind, or wastage engendered by inventory shortage as discussed above, were major economic factors which directed finding a means for end-jointed boards. It was thought that the jointing of floor boards was not practical because the joints were too weak to withstand the heavy loading, and vertically directed loading at that, of the cargoes carried by the trucks.

Further investigations by workers in this field indicated that if jointing of floor boards for truck use were to be successful after all, finger jointing offered good promise. Even at that, another obstacle stood in the way, namely orientation of the finger joint profile. Where two floor boards are to be finger-jointed together end to end, each such end before it is intermeshed with its engaging end of the other board, will exhibit a profile or contour whose shape resembles that of a rack gear defined by gear teeth, peaks and valleys. These "racks" are fully visible upon generation of the finger joint profile, but before the preliminary jointing together to be followed by gluing and finishing. The so visible profiles admit of several orientations: (1) the peaks of the rack gear teeth —and for that matter, their valleys—extend parallel to the thickness direction, that is parallel to the shortest dimension (usually) of the board. This means that upon completion of the preliminary jointing and indeed of final jointing, there will remain visible on the top surface of the jointed boards and hence on the finished floor surface, a zig-zag pattern. The truck floor constructing manufacturer favors this, because it is a relatively strong joint capable of withstanding the vertical loading by the truck's cargo. However, the purchaser of the floor or of the truck with the floor installed in it, objects to the zig-zag pattern for aesthetic reasons. The peaks and valleys of the rack gear teeth extend parallel to the width direction of the board, that is parallel to the second greatest dimension of the board; usually, the length direction is the greatest. With this orientation, once the two boards have been jointed, even merely preliminarily, visible on their top surface, though perhaps even barely visible at that, would be a straight line which corresponds to the width of the boards. This line, would be visible, perhaps just barely visible, also on the finished truck floor. This orientation has been utilized in finger joint applications other than for truck flooring; see for example brochures published by manufacturers of finger joint woodworking machinery, for example brochure published by Lewyn Machinery Company, Smyrna, Georgia, U.S.A., their Catalog CE-345L-1, directed to IMC woodworking machinery, published October, 1984; see also brochure published by Smi Stebar Machinery, Inc., Cambridge, Ontario, Canada, their brochure directed to "Economical Finger Jointing System".

Although acceptable for other woodworking applications, the "straight-line-visible" finger joint profile had not been favorably considered by truck floor board manufacturers because they considered such joints to be too weak to withstand the vertical cargo loading in trucks, and yet this is the orientation which their purchasers desired.

Applicants have recently made refinements in the technique of finger jointing, and in "straight-line-visible" finger jointing, and surprisingly have produced joints which are from about 70% to 80% as strong as laminated floor boards without finger joints, and therefore suitable for truck flooring. This development has made the present invention practical.

It is the general object of the invention to provide a truck floor employing finger jointing of floor boards such that the scrapping of remnant floor boards is minimized and instead these remnant boards are utilized in making lengths of floor boards destined for use in the laying of truck floors.

It is also an object of the invention to provide truck floor methodology utilizing finger jointing techniques whereby floor boards of given standard lengths can be converted to floor boards of some other standard lengths, lesser or greater lengths than the standard lengths of the original floor boards.

Notice, in the just stated object of the invention, the creation of floor boards of greater than original lengths, as well as the creation of floor boards of lesser than original length. Historically speaking, the creation of the floor boards of lesser lengths has posed the difficulties mentioned in the introduction of the specification; once this problem was overcome, similar concepts could be applied to the creation of floor boards of greater than original length.

SUMMARY OF THE INVENTION

In accordance with a first principal embodiment of the invention and as a first subordinate embodiment or variation thereof, one begins with a remnant floor board from a previous severing-type or saw-cutting operation performed at a saw-cutting station. Such a remnant floor board at one end thereof is given a finger joint profile with orientation "straight line visible" as described above. A full length floor board of original standard length is also given a finger joint profile, with the same orientation, at one end. The two floor boards with finger joint profile—one of the shorter remnant length, and the other of full original standard length—are meshed and glued together at a gluing station. Assuming that the so formed composite finger jointed board has a length which includes one or more integral multiples of the to-be-newly-created standard lengths these one or more new-standard-length boards are severed or cut off at a saw-cutting station, so that the finger joint is included in a full new-length board rather than a new remnant board. This is done to avoid the subsequent creation of a still further board of new standard length which has more than one finger joint, if such avoidance is possible. With a new remnant as the initially available piece, another complete cycle of the kind just described, may be started.

In the preceding paragraph two assumptions were made, namely firstly that we began with the floor board remnant stemming from a previous operation, and secondly that the lengths of the composite finger-jointed remnant plug full-length original board had greater length than the new standard length floor board about to be severed out of the composite board. This assumption will necessarily hold true where the new standard length is lesser than the original standard length, and it may even hold true in some, but not necessarily all cycles applicable to creation of floor boards having standard length greater than the standard original lengths. Therefore, as a second subordinate embodiment or variation, in the case of production of floor boards of greater than original lengths, it may be necessary to join to the initial remnant one floor board of the original standard length, and join to that one original length board, another original standard length board, and so forth until one arrives at the situation where the multiple finger jointed composite board has a length which is equal to or is greater than the desired new standard length.

Reverting to the above mentioned first assumption, namely that one begins with a remnant, this is not necessary. For further variations, one could equally well begin with a full length standard board. If the new standard length is to be lesser than the original standard length, one would simply sever at the saw cutting station the one or more boards of new standard length from the board of original standard length, and be left with a remnant which could then serve as the remnant for the kind of cycle contemplated above in the first variation. If on the other hand the ultimate standard length is to be greater than the original standard length, one would begin with finger jointing two boards of original standard length, and if necessary even more than two, until the ultimately desired standard length is achieved or passed, and would then sever the new standard length and thus leave a new remnant which may be thought of as suitable for initiating another cycle as discussed above in the second variation.

In accordance with a second principal embodiment of the invention, a succession or "train" of boards of at least one initial standard length is formed, successive ones in the train being finger jointed to one another. From this train are severed boards of final or desired standard length. The two operations, finger jointing, and severing may proceed essentially concurrently, at separate respective stations.

Elaborating on the concept of the second principal embodiment of the invention, as to the initial board of the train to be formed, that is the initial board of original standard length, its leading edge will usually not be given a finger joint profile, so that that board will advance through the finger joint profile cutting station, in the direction towards and past the gluing station, on towards and past the board-severing station. The movement of the initial board, and for that matter the next following board or boards, will be interrupted upon occurrence of one of the following, whichever occurs first in time:

(a) When the trailing edge of a board of a finally desired length is located just under the severing cutter. Severance is made and board movement resumes until either even (a) recurs or the event (b) occurs initially or even recurs, whichever happens next; or (b) The trailing edge of a board of original standard length arrives at the finger joint profile cutter. That trailing edge is subjected to finger joint profile cuttings, and so is the leading edge of the next following board.

In accordance with a third embodiment of the invention, a first floor board of a first standard length is cut into a first floor board of a second standard length and a first remainder board. The trailing end of the first remainder board and the leading end of a second floor board of a first standard length are finger-jointed and then glued and joined together so as to form a composite board. The composite board is then cut into a second floor board of a second standard length and a second remainder board. This process can be a continuous process whereby the remainder board and the board immediately behind the remainder board are finger-jointed and then glued together to form a composite board which is cut into another board of said second standard length and another remainder board.

Variations of the invention, in addition to the variations referred to above, and also further objects, advantages, and features of the invention will be better understood from the following, more detailed description of which the appended claims and abstract form part, when considered together with the accompanying drawings in which:

FIG. 1 depicts symbology utilized in the presentation of FIG. 2;

FIG. 2A and 2B, placed side-by-side and as such considered collectively as FIG. 2, show a schematic or symbolic illustration of the invention;

FIG. 3 is an isometric view of a truck floor which incorporates floor boards processed in accordance with the invention; and FIG. 4 is a block diagram of another embodiment of the invention.

DESCRIPTION OF PREFERRED EMBODIMENTS

Figure 2B:
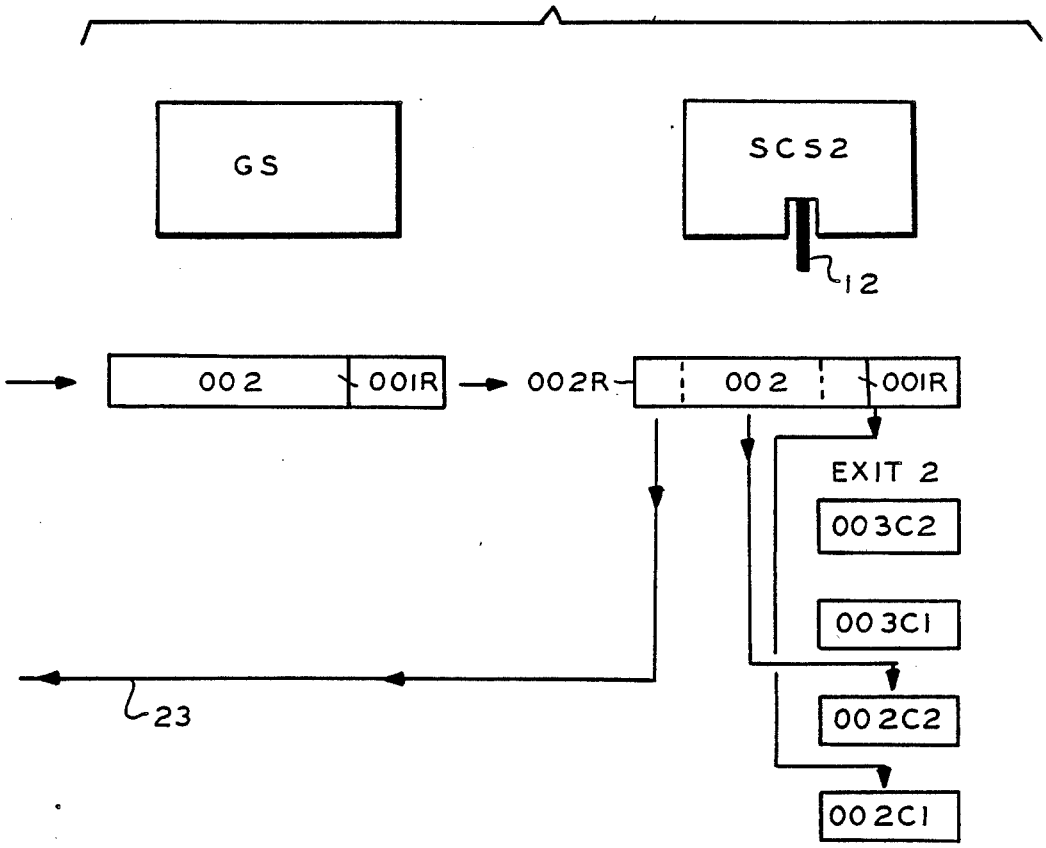

FIG. 1 shows in full form the symbology which is utilized in FIG. 2 in more abridged form. In FIG. 1 are shown floor boards of initial standard length, for example twenty foot long floor boards imported from Malaysia, in isometric presentation, and underneath such isometric presentation, in simple two-dimentional presentation. In FIG. 2, only the latter, two-dimensional presentation is utilized. Floor board 001 is of the initial standard twenty foot length. Notice that 001 is presented without suffix; this indeed implies that floor board 001 is of the initial standard length, and similarly for the indicated floor board 002. Reference numeral 21 designates a proposed cutting line or planar surface, along which the floor board 001 is to be cut at a saw-cutting station, into new standard length of say, twelve feet—this is designated by board 001C—and into an eight foot long remnant 001R. The suffix C may be read as "complete" or "cut", and the suffix R may be read as "remnant" or "remainder". The remnant board 001R will have cut into its trailing edge or trailing end surface 21 a finger joint profile with the preferred orientation discussed in the specification introduction. In FIGS. 1 and 2 the forward flow is assumed to be from left to right; hence for the remnant board 001R its left edge 21 is its trailing edge. The floor board 002 of initial standard length, will have placed a figure joint profile on its right or leading edge which is to be glued onto the trailing edge 21 of the remnant board 001R, as will be described with reference to FIG. 2.

In FIG. 2 are shown two saw-cutting stations SCS1 and SCS2, a finger joint profile cutting station FJS, and gluing station GS. The indication of two saw-cutting stations SCS1 and SCS2 may be considered to be merely symbolic of just one single such station SCS with two stations illustrated as a matter of convenience in drawing. The invention can be practiced with just one single such station, and certain advantages accrue from such arrangement, for example the lesser cost of providing merely one station. However, the invention can also be practiced with two or more separate saw-cutting stations, and certain advantages accrue from such an arrangement, notably reduction in reverse flow and hence speed-up in forward flow of the process.

The stations SCS1 and SCS2 may be equipped with conventional circular saws 11 and 12 with suitable conventional work tables. The entering boards are clamped thereon, accurately measured, and then cut such that one of the sawed off board pieces is of the final standard length, for example the mentioned twelve foot length. Were only one saw-cutting station SCS used, only a single saw would then be required rather than the two saws 11 and 12; similarly only a single EXIT would also be required.

Although commercially available is machinery which not only performs the finger joint profile cutting function, but also the gluing function, for purposes of the invention it is preferred that the gluing function performed separately from the finger joint profile cutting function. To this end, the finger joint profile cutter FJS is constituted of commercially available equipment such as a vertical milling machine or spindle machine, for example, the vertical MOAK No. 7, manufactured by Moak Machine and Foundry Co., of Port Huron, Michigan, U.S.A., or the Model No. Fn No. 700 manufactured by Simca Company of Italy. The cutter FJS is further constituted by fitting into the vertical spindle machine a commercially available finger joint profile cutter, for example, of the kind manufactured by Lewyn Machinery Co., of Smyrna, Georgia, U.S.A.

The gluing station GS is required to perform the function of applying the glue to the two boards to be jointed together, then pressing, and finally application of radio-frequency heating by means of platens. A commercially available unit which performs these three functions in one unit is made by Rosenquist Company of Wilkesborough, North Carolina, U.S.A.

In addition, a machine that includes a finger joint cutter and a gluing station may also be used. An example of this type of machine is the HOWIAL Compact Finger Jointing Machine HVP 10, manufactured by Howial of West Germany.

Recall that described will be the methodology of the invention as applied to generating, from boards of initial standard length of 20 feet, boards of final standard length of 12 feet. Shown in FIG. 2 is the previously mentioned floor board 001; it has passed the ENTER point and has arrived at the saw cutting station SCS1 where it is about to be cut or severed into a final 12 foot board 001C which is removed at EXIT 1 and into the 8-foot remainder board 001R. The latter is shown as having passed the finger joint profile cutting station FJS where its trailing edge has been shaped to the finger joint profile by the cutter 13 at the station FJS. A second floor board 002 of initial standard length is shown as being fed via the ENTER point of the system of FIG. 2 to the station FJS. The transit of the board 002 may be thought of either bypassing the station SCS1 or else passing through it but without undergoing any cutting. At the station FJS, the leading edge of the board 002 is given a finger joint profile. Thereafter boards 001R and 002 are glued together at the station GS so that a board of composite length of 28 feet emerges. This progresses to the station SCS2 where the composite board is to be severed twice; first a "leading" board 002C1 of 12 foot length is cut and passed out via EXIT 2. The board 002C1 contains the finger joint already made. It is desirable to make the cuts in this order as this minimizes the possibility of more than one finger joint appearing on one finished board. Then a second 12 foot length board 002C2 is cut from what had been the composite 28-foot long board. This leaves a new remainder board 002R which is 4 feet long.

The remainder board 002R will circulate as shown diagramatically by the arrow path 23, in the direction of entering the finger joint profile cutting station FJS, immediately to be followed by a new board of initial standard length 003, which has arrived in the circulation via the ENTER point. The remainder board 002R and the initial standard length board 003 will undergo processing which up to a point is analogous to of the boards 001R and 002 previously, namely: (1) cut finger joint profile at the station MJS; (2) form a composite board at the gluing station GS, this is 24 feet in length; (3) sever the new composite board into two boards 003C1 and 003C2 which however, are both of the final 12 foot length. The boards 003C1 and 003C2 leave the system at EXIT 2 and no further remainder is left; hence the operation so far described, could be repeated cyclically. One could begin with another 20 foot board 004 which would be processed in the same manner as the board 001.

The operation has been described as beginning with a board of initial standard length 001. However, as a variation of the invention, it is quite clear that the process might have begun with a remainder board 001R which had been left over from a previous processing operation. Such a board 001R, together with initial standard length board 002 could be subjected to cutting of finger joint profiles, thus commencing a cycle at this point. Similarly, a remainder 002R, a "left-over" from a previous processing, worked together with a board of initial standard length 003, could be thought of as beginning a cycle, as well.

As a further variation of the invention, described in outline form is the process applied to converting initial standard lengths of 20 feet to final and greater standard length of 32 feet. This will also be seen to be cyclical, and therefore capable of variations analogous to the variations stated for the process illustrated in FIG. 2. To arrive at 32 foot lengths, we arbitrarily begin with full length 20-foot boards of initial standard length, that is we assume that there were no remainder boards from a previous operation.

1. Enter two boards of full 20 foot length; cut meshing finger joint profile at station FJS; glue together at station GS to arrive at a composite board of 40 foot length; at station SCS22 sever at EXIT 2 the desired 32 foot length—it necessarily contains a finger joint—; this leaves a remainder board of 8 foot length.

2. Circulate the 8 foot long remainder board followed by two boards of initial standard length of 20 feet. Prepare these three boards for finger jointing at the station FJS; in this case the relatively more leading 20 foot long board would have a profile cut at both ends, name the leading and trailing surfaces. Glue the three boards together at the station GS to arrive at a composite board of 48 foot length; at the station SCS2 sever and EXIT out the leading 32 foot length, and circulate the 16 foot remainder.

3. Repeat Step 2 using the new 16 foot remainder with a new 20 foot board; this will result in a new 32 foot length, and a 4 foot remainder.

4. Utilizing the latest 4 foot remainder, join to it two 20 foot boards, and repeat the previous steps; this will result in a new 32 foot length plus a 12 foot remainder.

5. Using the 12 foot remainder, repeat Step 4; this yields a 32 foot board without further cutting.

The examples so far given, namely the full-length description of FIG. 2, and the production of greater-than original-length boards, point to the following. It is possible to arrive at the end of a cycle without any saw-cutting of a composite board at all; this was the case in the latter example (32-foot lengths). Or it is possible, to arrive at the end of the cycle by cutting into equal, finally desired lengths, a composite board which measures plural integral multiples of desired length. (12-foot lengths) Either way there is no remainder board at the end of such a cycle. However, this statement must be somewhat qualified; it is more accurate to talk in terms of "no-useable" remainder rather than "no remainder". This is, because the process so far described is idealized, in that it has ignored the loss in wood material which occurs in preparing for finger jointing. The loss in board length due to cutting the finger joint profile is not negligible; although it is of the order of $1\frac{1}{4}$ inches at each surface subjected to finger joint profile cutting, this is appreciably greater than the one-eighth inch length-tolerance allowed for truck floor boards. It is easily possible to observe this tolerance, by accurate measurement and accurate saw-cutting at the stations SCS. However, the loss due to finger joint profile cutting implies that an exact end-of-cycle without any remainder board is unlikely to be achieved. Practically speaking, one would come to a situation where the remainder board is too small in length to warrant cutting a finger joint profile in it. Such a cycle might be said to end with a situation of "no useable remainder board left". One would simply begin a new cycle with a floor board with initial standard length.

The described invention admits of still further variations. In the example described with reference to FIG. 2, we began with the cut of one board of initial standard length (20 feet). This was followed by steps which might be said to be "strictly series", in the sense that the initial cut was followed by finger joint of the remainder to a new board of standard length, then cut final length or lengths from the composite boards, leaving a new remainder and repeating as was done before with the previous remainder. It is within the scope and contemplation of the invention to operate "in multiples" and then "serialize in multiples". For example, if the chosen multiple is three, one would begin by cutting at the station SCS1 12 foot length from each of three standard 20 foot length boards, and sending to EXIT the three 12 foot lengths, while preserving the three 8 foot remainder boards, which would then each be given a finger joint profile. This would be continued by providing finger joint profile in three 20 foot length boards, and creation of three composite boards of 28 foot length. In the continuation of this process there would occur mainly triplication of the previously described "strictly series" process.

Figure 4:
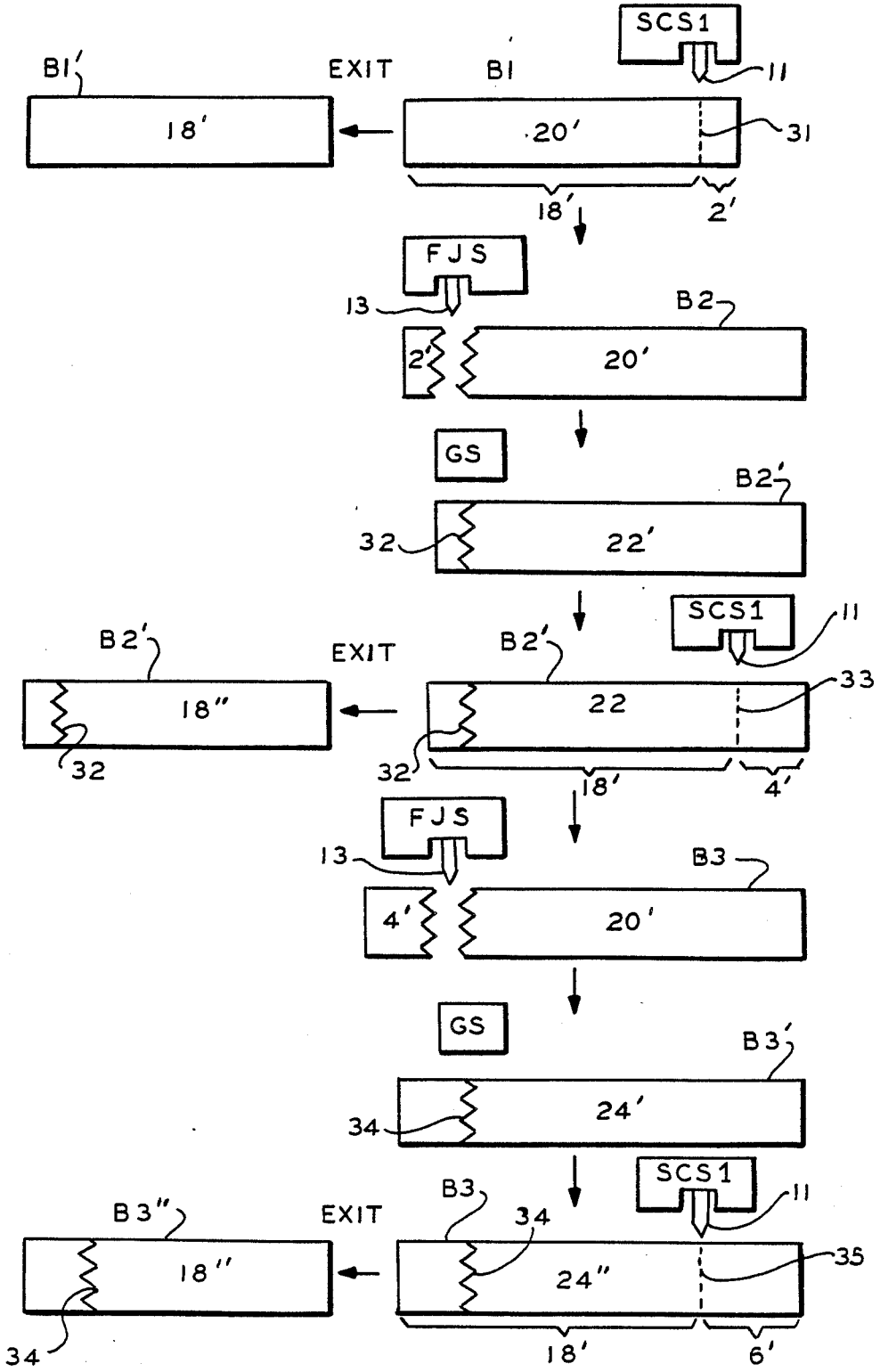

Another embodiment of the present invention may be carried out as follows:

In this example, a line of boards B1, B2, and B3 as shown in FIG. 4, each 20 feet in length, runs along a cutting assembly line. In this example, 18 foot boards are desired to be cut. As shown in FIG. 4, a 20 foot board B1 is cut at SCS 1 by blade 11 into an 18 foot board and a 2 foot remainder along line 31. The 18 foot board B1' exits the assembly line, while the 2 foot board becomes the leading board. The 2 foot board is immediately in front of board B2. The 2 foot board and board B2 are then given finger joints at FJS by finger joint cutter 13. The joints of the 2 foot board and board B2 are then glued by GS to form a joint bond 32, thus resulting in a board B2' which is 22 feet long. Board B2' is then cut by blade 11 of SCS 1 along line 33 into board B2' which is 18 feet long and also into a 4 foot board. The 18 foot board exits the assembly line and the 4 foot board becomes the leading board, which is now immediately ahead of board B3, which is 20 feet long. The 4 foot board and board B3 are finger jointed at FJS by finger joint cutter 13. The 4 foot board and board B3 are then glued by GS, which forms a joint bond 34. Thus, a 24 foot board B3' is formed. Board B3' is then cut by cutter 11 of SCS 1 along line 35 into an 18 foot board B3'' and a 6 foot board. Board B3' exits the assembly line and the progression may continue with the 6 foot board as the leading board which is immediately ahead of another 20 foot board (not shown). The assembly line may contain an unlimited number of boards of a standard length which can be cut and/or finger jointed and glued according to the method described above. In this way, boards of a desired length may be cut from boards of another standard length on a continuous basis.

As another alternative embodiment, two boards of a first standard length, for example 20 feet are finger-jointed such that the trailing end of the first of said boards is capable of mating with leading end of the second of said boards. The finger-jointed ends of the first and second boards are glued together so as to form a composite board of a second length, for example 40 feet. The composite board is then severed into at least two boards of a third length, for example 18', and into a remainder board as well. The remainder board, for example, a board 4 feet in length, as well as another single board of a first standard length, are finger jointed to form mating finger-jointed ends, and glued together so as to form a second composite board, which is of another length, for example 24'. This second composite board is then severed into at least one board of said third standard length, for example, 18' and a second remainder board of another length, for example, 6'. This remainder board may be finger jointed and glued to another board of a first standard length, thereby enabling boards of a desired length to be cut from boards of another standard length on a continuous basis.

Figure 3:
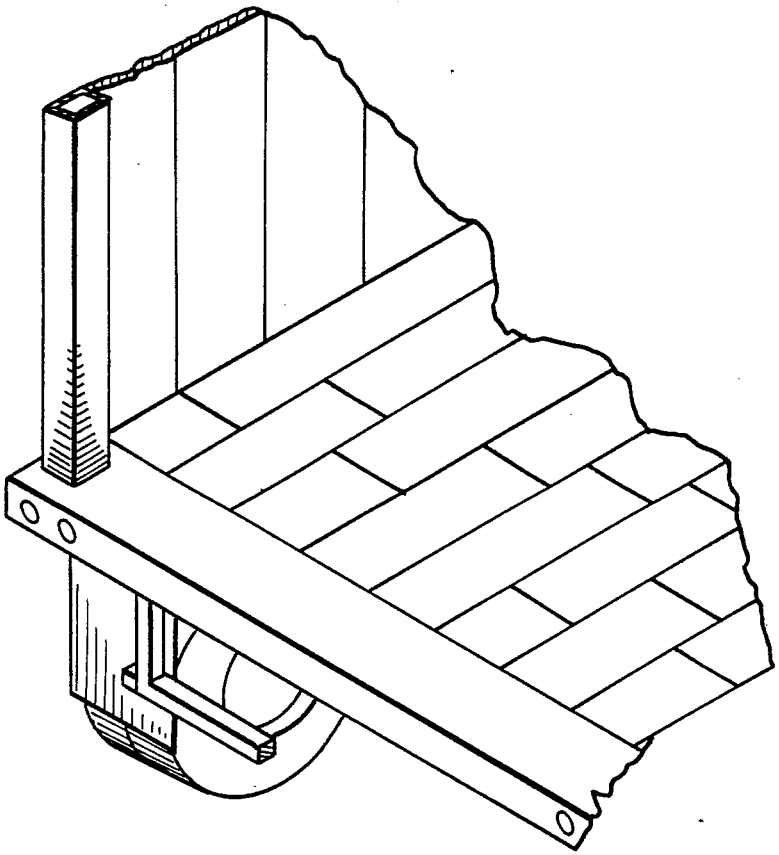

FIG. 3 shows the interior of a truck having placed in it truck flooring constructed in accordance with the methodology of this invention. In this instance, the truck length may be assumed to be greater than the initial standard length (20 feet) so that each one of the boards is a composite board with a finger joint in it. Note that the joints are made with the preferred orientation, namely they appear visibly on the truck floor as straight line segments which are oriented in the width direction. Note that the straight line segments are staggered from each other. This is done not only out of aesthetic considerations, but also out of considerations of structural strength, namely greater strength and better ability to withstand vertical loading than would be available from an array in which these line segments formed a continuous straight line.

It is to be understood, however, that the scope of the invention is not to be limited to the specific embodiments described above. The invention may be practiced other than as particularly described and still be within the scope of the accompanying claims.

What is claimed is:

1. In a method for producing truck floor boards having a desired standard length from truck floor boards having at least one initial standard length and remainder floor boards, the truck floor boards of desired standard length being suitable for installation in one or more trucks to form a substantial part of the flooring thereof, the improvement which comprises (a) attaching to a remainder floor board, a floor board of initial standard length to produce a joined, composite board having a length which is either equal to or greater than the desired length; and (b) in the case where the joined board has a length greater than the desired length, cutting from the joined board one of: as many boards of desired length as are available, or as many boards of desired length as are available and a new remainder board which is suitable for attachment, to a floor board.

2. The improvement as claimed in claim 1, further comprising:

(c) repeating the steps (a) and (b), the initial repetition employing an available and suitable new remainder board recited in the aforesaid step (b), as the remainder board recited in the repetition step (a), and any subsequent repetition employing an available and suitable new remainder board produced in the preceding repetition of step (b), as the remainder board in the current repetition of step (a).

3. The improvement as claimed in claim 1, and applicable to the production of floor boards having desired standard length less than initial standard length, comprising the following step (p) prefatory to step (a):

(p) cutting from a board of initial standard length, as many boards of desired length as are available, plus a remainder board utilizable as the remainder board in step (a).

4. The improvement as claimed in claim 2, and applicable to the production of floor boards having desired standard length less than initial standard length, comprising the following step (p) prefatory to a repetition of step (a):

(p) cutting from a board of initial standard length, as many boards of desired length as are available, plus a remainder board utilizable as the remainder board in step (a).

5. The improvement as claimed in claim 1, and applicable to the production of floor boards having desired length greater than initial standard length, comprising the following steps (p1) and (p2) prefatory to step (a):

(p1) attaching to a floor board of initial standard length, another floor board of initial standard length to produce a joined, composite board which has essentially twice the initial standard length; and (p2) cutting from the joined board obtained in step (p1): one board of desired standard length, plus a remainder board utilizable as the remainder board in step (a).

6. The improvement as claimed in claim 2, and applicable to the production of floor boards having desired length greater than initial standard length, comprising the following steps (p1) and (P2) prefatory to a repetition of step (a):

(p1) attaching to a floor board of initial standard length, another floor board of initial standard length to produce a joined, composite board which is essentially twice the initial standard length; and (p2) cutting from the joined board obtained in step (p1): one board of desired standard length, plus a remainder board utilizable as the remainder board in step (a).

7. In a method for producing truck floor boards having a desired standard length from truck floor boards having at least one initial standard length and remainder floor boards, the desired standard length being greater than the initial standard length, the truck floor boards of desired standard length being suitable for installation in one or more trucks to form substantial part of the flooring thereof, the improvement which comprises:

(a) attaching to a remainder floor board, a succession of floor boards of initial standard length which are successively, similarly attached one to the next-following one, to produce a joined, composite board having a length which is either equal to or just greater than the desired length; and (b) in the case where the joined board has a length greater than the desired length, cutting from the joined board one of: that one board of desired length, or as many boards of desired length as are available and a new remainder board which is suitable for attachment to a floor board.

8. The improvement as claimed in claim 7, further comprising:

(c) repeating the steps (a) and (b), the initial repetition employing an available and suitable new remainder board recited on the aforesaid step (b), as the remainder board recited in the repetition step (a), and any subsequent repetition employing an available and suitable new remainder board produced in the preceding repetition of step (b), as the remainder board in the current repetition of step (a).

9. The improvement as claimed in claim 7, (p1) attaching to a floor board of initial standard length, a succession of floor boards of initial standard length, and attaching these successively one to the next-following one, to produce a joined, composite board having a length which is just greater than one desired length; and (p2) cutting from the joined board obtained in step (p1): that one board of desired standard length, plus a remainder board utilizable as the remainder board in step (a).

10. The improvement as claimed in claim 8, comprising the following steps (p1) and (p2) prefatory to a repetition of step (a):

(p1) attaching to a floor board of initial standard length, a succession of floor boards of initial standard length, and attaching these successively one to the next-following one, to produce a joined, composite board having a length which is just greater than one desired length; and (p2) cutting from the joined board obtained in step (p1): that one board of desired standard length, plus a remainder board utilizable as the remainder board in step (a).

11. The improvement as claimed in claim 1, wherein the in step (a) recited boards are provided in a multiple amount which is uniform for the number of remainder floor boards, the number of floor boards of initial standard length, and the number of produced joined, composite boards, and wherein first the step (a) is performed on the multiple boards provided for the execution of step (a), and then the step (b) is performed on the multiple joined boards.

12. The improvement as claimed in claim 7, wherein the in step (a) recited boards are provided in a multiple amount which is uniform for the number of remainder floor boards, the number of succession of floor boards of initial standard length, and the number of produced joined, composite boards, and wherein first the step (a) is performed on the multiple boards provided for the execution of step (a), and then the step (b) is performed on the multiple joined boards.

13. The improvement as claimed in claim 11 further comprising:

(c) repeating the steps (a) and (b), the initial repetition employing available and suitable multiple new remainder boards recited in the aforesaid step (b), as the multiple remainder boards in the repetition step (a), and any subsequent repetition employing an available and suitable multiple new remainder boards produced in the preceding repetition of step (b), as the multiple remainder boards in the current repetition of step (a).

14. The improvement as claimed in claim 12 further comprising:

(c) repeating the steps (a) and (b), the initial repetition employing available and suitable multiple new remainder boards recited in the aforesaid step (b), as the multiple remainder boards in the repetition step (a), and any subsequent repetition employing an available and suitable multiple new remainder boards produced in the preceding repetition of step (b), as the multiple remainder boards in the current repetition of step (a).

15. A method of preparing truck floor boards which are to have a desired standard length, from truck floor boards having at least one initial standard length which differs from the desired standard length, comprising the steps of:

(a) cutting a finger joint profile in a trailing end surface, of a remainder floor board which has a length less than the desired standard length, that floor board hereinafter referred to as the first floor board, the other than the first, hereinafter mentioned floor boards in the ordinal number series (first, second, etc.) being of the initial standard length, (b) cutting a finger joint profile in a leading end surface, of a second floor board which is of the initial standard length, the leading end surface recited in this step (b) to be glued to said trailing end surface recited in step (a) to complete a finger joint, (c) until the prospective length of the by-ordinal-number identified boards recited in an initial or repeated sequence of steps (a) and (b) will include one desired length, if necessary, and for as long as is necessary to achieve such composite length, repeating:

(c1) step (a), but for the second board and step (b) for a third board, (c2) step (a) but for the third board, and step (b) for a fourth board, and so forth, (d) gluing successive by-ordinal-number-identified boards, by gluing the trailing end surface to the next following leading end surface, to form the composite board, and (e) severing, as many desired length-boards as are available from the composite board, thereby at the end of step (e), in at least some instances leaving a new remainder board, for utilization in another cycle of the steps (a) to (e).

16. A method as claimed in claim 15, wherein gluing step (d) is performed on the successive by-ordinal-number identified boards in the order named in the steps (a), (b), and (c), and the severing step (e) is performed also in analogous "first-in, first-out" order.

17. A method as claimed in claim 15, wherein each finger joint profile is oriented such, that the peaks and valleys of the fingers of the profile extend in the width direction of the respective board.

18. A method as claimed in claim 15, applicable to the case of desired standard length being less than the initial standard length, comprising the following prefatory step (p) which precedes the initial aforesaid step (a):

(p) severing, by saw-type-cutting, from a board of initial standard length, as many desired-length-boards as are available from that board of initial standard length, thereby creating the remainder board identified in claim 22 as the first board, and proceeding with that first board as prescribed in the successive steps (a), (b) etc.

19. A method as claimed in claim 18, wherein the gluing step (d) is performed on the successive by-ordinal-number identified boards in the order named in the steps (a), (b), (c), and the severing step (e) is performed also in analogous first-in, first-out order.

20. A method as claimed in claim 18, wherein each finger joint profile is oriented such, that the peaks and valleys of the fingers of the profile extend in the width direction of the respective board.

21. A method as claimed in claim 15, applicable to the case of desired standard length being greater than the initial standard length, further comprising the following prefatory step (p) which precedes the initial aforesaid step (a):

(p) providing as the first board, a board of initial standard length, rather than a remainder board, and proceeding with that initial standard length first board as prescribed for the first board in the steps (a) and (b) of claim 20.

22. A method as claimed in claim 19, wherein the gluing step (d) is performed on the successive by-ordinal-number identified boards in the order named in the steps (a), (b), (c), and the severing step (e) is performed also in analogous "first-in, first-out" order.

23. A method as claimed in claim 22, wherein each finger joint profile is oriented such, that the peaks and valleys of the fingers of the profile extend in the width direction of the respective board.

24. A method as claimed in claim 15, wherein each of the by-ordinal-number-identified floor boards is provided in a multiple amount which is uniform for the multiple first boards, the multiple second boards, etc., the first boards being of substantially equal length, and wherein each one of the aforesaid steps (a), (b) et cetera is performed on the multiple boards of that same ordinal number rank, which is applicable to the respective one of the steps (a), (b) etc.

25. A method as claimed in claim 24, wherein each finger joint profile is oriented such, that the peaks and valleys of the "rack gear teeth" or "fingers" of the profile extend in the width direction of the respective board.

26. A method of continuously producing floor boards, comprising:

cutting a first floor board of a first standard length into a first floor board of a second standard length and a first remainder board;

finger-jointing the trailing end of said first remainder board and finger-jointing the leading end of a second floor board of a first standard length;

gluing said trailing end of said first remainder board and said leading end of said second board of a first standard length and joining said leading end and said trailing end to form a composite board; and cutting said composite board into a second floor board of said second standard length and a second remainder board.

27. A method of continuously producing floor boards comprising:

finger-jointing two boards of a first standard length such that the trailing end of said first board is capable of mating with the leading end of said second board;

gluing said finger-jointed ends of said first and second boards together so as to form a composite board of a second length;

cutting said composite board into a board of a third length and a remainder board;

finger jointing said remainder board and a single board of said first standard length, thereby forming mating finger-jointed ends of said remainder board and said single board of said first standard length; and gluing said finger-jointed ends together so as to form a second composite board.

28. The method of claim 27, and further comprising:

cutting said second composite board into a board of said third standard length and a remainder board.

29. A method of continuously producing floor boards, comprising cutting a first floor board of a first standard length into a first floor board of a second standard length and a first remainder board;

jointing the trailing end of said first remainder board and jointing the leading end of a second floor board of a first standard length such that the trailing end of said first board is capable of mating with the leading end of said second board;

attaching said leading end and said trailing end to form a composite board; and cutting said composite board into a second floor board of said second standard length and a second remainder board.

30. A method of continuously producing floor boards comprising:

jointing two boards of a first standard length such that the trailing end of said first board is capable of mating with the leading end of said second board;

attaching the jointed ends of said first and second boards together so as to form a composite board of a second length;

cutting said composite board into a board of a third length and a remainder board;

jointing said remainder board and a single board of said first standard length, thereby forming mating jointed ends of said remainder board and said single board of said first standard length; and attaching said jointed ends together so as to form a second composite board.

31. The method of claim 30, and further comprising:

cutting said second composite board into a board of said third standard length and a remainder board.

32. A method of continuously producing floor boards, comprising:

cutting a first floor board of a first standard length into a first floor board of a second standard length and a first remainder board;

attaching the trailing end of said first remainder board to the leading end of a second floor board of a first standard length to form a composite board; and cutting said composite board into a second floor board of said second standard length and a second remainder board.

33. A method of continuously producing floor boards of a desired length, comprising:

attaching a first board of a first standard length to a second board of a first standard length to form a composite board of a second length;

cutting said composite board into a board of said desired length and a remainder board, said desired length being greater than said first standard length; and attaching said remainder board to a single board of said first standard length so as to form a second composite board.

34. The method of claim 33, and further comprising:

cutting said second composite board into a board of said desired standard length and a remainder board.

* * * * *